US006668536B2

(12) United States Patent
Wassenhoven

(10) Patent No.: US 6,668,536 B2
(45) Date of Patent: Dec. 30, 2003

(54) OPEN-END SPINNING ARRANGEMENT

(75) Inventor: Heinz-Georg Wassenhoven, Mönchengladbach (DE)

(73) Assignee: W. Schlafhorst AG & Company (DE)

( * ) Notice: Subject to any disclaimer, the term of this patent is extended or adjusted under 35 U.S.C. 154(b) by 131 days.

(21) Appl. No.: 09/954,346

(22) Filed: Sep. 17, 2001

(65) Prior Publication Data

US 2002/0033013 A1 Mar. 21, 2002

(30) Foreign Application Priority Data

Sep. 16, 2000 (DE) ..... 100 45 918
Jun. 16, 2001 (DE) ..... 101 29 132

(51) Int. Cl.[7] ..... D01H 4/10
(52) U.S. Cl. ..... 57/407; 57/408
(58) Field of Search ..... 57/404, 406, 407, 57/408, 409, 410, 411, 412, 413

(56) References Cited

U.S. PATENT DOCUMENTS 5,471,829 A * 12/1995 Billner ..... 57/413
5,540,043 A * 7/1996 Raasch ..... 57/301
2002/0033013 A1 * 3/2002 Wassenhoven ..... 57/406

FOREIGN PATENT DOCUMENTS

DE OS 2 041 957 3/1972
DE OS 2 327 347 12/1974
DE OS 2 327 348 12/1974
DE 23 40 029 A1 2/1975
DE 40 36 017 A1 7/1991
DE 43 09 704 C1 7/1994
DE 43 09 947 A1 9/1994
DE 44 04 503 A1 9/1994
DE 43 23 213 A1 1/1995
EP 1188850 A2 * 3/2002 ..... D01H/4/08

OTHER PUBLICATIONS

European Search Report Dated: Aug. 8, 2002.
German Search Report.

* cited by examiner

*Primary Examiner*—John J. Calvert
*Assistant Examiner*—Shaun R. Hurley
(74) *Attorney, Agent, or Firm*—Kennedy Covington Lobdell & Hickman, LLP

(57) ABSTRACT

An open-end spinning arrangement (1) comprises a stationary spinning box housing (2) arranged on a base frame of a textile machine for seating a high speed spinning rotor (7) in a vacuum-charged rotor housing (8), a sliver opening unit (4) connected to the spinning box housing (2) via a linear guide (3), and a cover element (23) for closing the rotor housing (8). The sliver opening unit (4) is releasably connected to a connecting bracket (30) of the linear guide (3), and an opening roller (12) driven by an individual motor and a sliver draw-in cylinder (14) driven by a step motor (15) are arranged inside the sliver opening unit (4).

15 Claims, 11 Drawing Sheets

OPEN-END SPINNING ARRANGEMENT

CROSS-REFERENCES TO RELATED APPLICATIONS

This application claims the benefit of German patent application 100 45 918.8 filed Sep. 16, 2000, herein incorporated by reference and German patent application 101 29 132.9 filed Jun. 16, 2001.

FIELD OF THE INVENTION

The present invention relates to an open-end spinning arrangement and, more particularly, to an open-end spinning arrangement having a stationary spinning box housing arranged on the base frame of a textile machine for seating a high speed spinning rotor in a vacuum-charged rotor housing, having a sliver opening unit connected to the spinning box housing via a linear guide, and having a cover element for closing the rotor housing.

BACKGROUND OF THE INVENTION

Various embodiments of open-end spinning arrangements are known in connection with rotor spinning machines.

For example, German Patent Publication DE 43 23 213 A1 describes an open-end spinning arrangement with a support frame which has been fixed in place on the machine base frame of a spinning machine. The support frame has a support disk seating arrangement, an axial bearing, as well as a rotor housing, which can be closed by means of a pivotably seated cover element.

In this open-end spinning arrangement, a so-called conduit plate, a sliver draw-in cylinder, an opening roller, and a single-piece fiber guide conduit are arranged in the cover element.

The drive for the opening roller is provided in a customary way by means of a tangential belt, while the sliver draw-in cylinder is connected via a worm gear with a drive shaft extending over the length of the machine.

In the closed state of the rotor housing, a so-called conduit plate adapter is arranged on the conduit plate and projects into the spinning rotor. The conduit plate adapter carries a yarn-draw off nozzle and the mouth of the fiber guide conduit, so that the individual fibers exiting the mouth of the fiber guide conduit are directly fed to the fiber slide surface of the spinning rotor arranged immediately adjacent the fiber guide conduit.

In the course of producing high-quality open-end yarns, it is necessary to meet defined conditions regarding the mutual arrangement of the spinning elements, for example their distance and/or their size. Therefore, the pivotable arrangement of the cover element results limits the minimum diameter of the usable spinning rotor.

Thus, even with the arrangement of the pivot axis of the cover element almost vertically below the rotor opening, such as is described in German Patent Publication DE 43 23 213 A1, and with the relatively shallow pivot range thereby achieved, the employment of very small spinning rotors, for example of a diameter of <28 mm, in the known spinning arrangements is very problematical.

Therefore attempts have already been made in the past to construct open-end spinning machines whose rotor housing cannot be closed by means of a pivotably seated cover element, but which has a cover element which is connected via a linear guide device with a stationary part of the open-end spinning arrangements.

German Patent Publications DE-OS 23 27 347 and DE-OS 23 27 348 show and describe rotor spinning arrangements with such a linear guide.

As can be seen in particular from FIGS. 1 and 2 of the drawings of these patent applications, these open-end spinning arrangements each have a stationary bearing housing for receiving a spinning rotor revolving inside a rotor housing, as well as a cover element, which is connected with the stationary bearing housing to be displaceable by means of a linear guide.

Furthermore, as already known, a sliver draw-in cylinder, as well as an opening roller, are arranged inside the cover element.

In such arrangement, the drive of the opening roller and the sliver draw-in cylinder takes place via central drive mechanisms extending over the length of the machine and are arranged fixed in place in the area of the stationary spinning rotor bearing housing.

In the interest of the uniformity of the yarn count, the sliver draw-in cylinder in particular must be driven free of slippage. Therefore, the transfer of the drive energy from the stationary drive mechanisms extending over the length of the machine to the sliver feed and opening devices arranged in the displaceably seated cover element is overall quite complicated and elaborate.

Because of their relatively failure-prone construction as a whole, the above described open-end spinning arrangements were not well-received and have therefore not been accepted in practical use.

Open-end spinning arrangements are also known wherein a sliver opening roller driven by an individual motor and/or a sliver draw-in cylinder driven by an individual motor are each arranged within the pivotably seated cover element.

An open-end spinning arrangement designed in this manner is described in German Patent Publication DE 43 09 947 A1, for example.

However, in connection with the spinning arrangement in accordance with such German Patent Publication DE 43 09 947 A1 it is disadvantageous that the cover element is connected with the spinning rotor bearing housing by means of a relatively difficult-to-access pivot shaft which, as explained above, leads to a definite restriction of the minimum rotor diameter, as well as, for example, to difficulties in connection with possibly required repairs of these individual drives.

Thus, with these known spinning arrangements the sliver opening unit driven by the individual motor and the sliver draw-in cylinder driven by the individual motor, integrated into the cover element, are relatively difficult to remove.

SUMMARY OF THE INVENTION

In view of the above described state of the art, an object of the present invention is to provide an improved rotor spinning machine. A more particular object of the invention is to further increase the productivity of rotor spinning machines by means of raising the number of revolutions of the spinning rotor and also to assure that the spinning arrangements are easy to access and to repair when needed.

In accordance with the invention, this object is addressed by providing an open-end spinning arrangement which basically comprises a stationary spinning box housing adapted to be arranged on a base frame of a textile machine for seating a high speed spinning rotor in a vacuum-charged rotor housing, a sliver opening unit connected to the spinning box housing via a linear guide, and a cover element for closing the rotor housing. In accordance with the present invention, the sliver opening unit is connected releasably to a connecting bracket of the linear guide, and the sliver opening unit comprises an opening roller driven by an individual motor and a sliver draw-in cylinder driven by a step motor arranged inside the sliver opening unit.

Advantageously, the use of a linear guide for seating the sliver opening unit enables very small spinning rotors to be employed if needed.

In turn, the use of extremely small spinning rotors makes possible a considerable increase of the number of revolutions of the spinning rotor, while at the same time assuring that the conditions of compatibility required for producing high-quality yarn, for example in regard to the positioning of the conduit plate adapter of the cover element, can be exactly maintained.

In a preferred embodiment, a step motor is employed for driving the sliver draw-in cylinder, and the sliver opening roller is driven by an individual motor, which assures in a simple and cost-effective manner a uniform individual fiber feeding into the spinning rotor, and thereby assures the exact uniformity of the yarn count at any time during the spinning process.

Furthermore, by means of an easily releasable connection of the sliver opening unit to the connecting bracket of the linear guide, it is furthermore assured that not only all components, for example the spinning rotor, remain easily accessible, but also that, when needed, the entire sliver opening unit can be replaced without problems, for example so that its individual drive mechanisms can be checked, and repaired in a special shop, if needed.

Thus, the preferred embodiment of open-end spinning arrangement in accordance with the present invention not only leads to a noticeable improvement of the productivity of such textile machines, but is also distinguished by ease of repair.

Furthermore, essential spinning components can be rapidly and dependably exchanged, for example in case of a batch change.

In one embodiment, the sliver opening unit is connected to the connecting bracket of the linear guide by means of a pivot shaft and is secured by means of a locking device.

In this manner, following the release of the locking device, the sliver opening unit can be tilted without problems via the pivot shaft, so that the greatest access to the spinning rotor, for example, is provided.

Since the pivot shaft is fixed in place in bearing slots which are open toward the front side of the arrangement, the sliver opening unit can also be removed without problems when needed and can be exchanged for another sliver opening unit, for example.

It is also advantageously provided that the locking device comprises a locking bolt, on which a spring force acts and which is displaceably seated on the connecting bracket of the linear guide, and a corresponding connecting bore is provided in the area of the sliver opening unit.

Thus, during the spinning operation, the sliver opening unit is pivoted inwardly to be dependably secured by means of latching of the locking bolt in the connecting bore and, at the same time, it is possible by means of retracting the locking bolt, which is preferably manually performed, that the locking device can easily be removed from service and the sliver opening unit can then be pivoted forward without problems and can be removed, if required.

It is further preferred that the sliver opening unit is connected with the connecting bracket of the first linear guide by means of a second, short linear guide.

In this manner, guide bolts may be arranged on the connecting bracket of this first linear guide, which slide in corresponding guide bores of a connecting body of the sliver opening unit.

The guide bolts in the present invention may each have an arresting groove in the area of their free ends, which can be engaged by a corresponding latching element.

These latching elements are preferably embodied as locking levers, which can be manually operated.

Thus, in the assembled state, two pivotably seated locking levers, which are biased by a spring element in an inwardly pivoted direction, engage the arresting grooves of the guide bolts and thereby interlockingly fix the sliver opening unit on the connecting bracket of the first linear guide.

In the present invention, the sliver draw-in cylinder, as well as the sliver opening roller, are driven by individual motors.

In a preferred embodiment, the sliver opening roller is driven by means of an individual electric motor drive, for example a d.c. or a.c. motor.

In this case this individual drive mechanism is embodied as a compact external rotor motor.

In an advantageous embodiment, a coupling device is arranged in the area of the connecting bracket of the first linear guide, which allows the mechanical separation of the electrical and pneumatic supply lines leading to the sliver opening unit.

In this manner, if required, the individual drive mechanisms arranged inside the sliver opening unit may be connected by supply lines, which can be easily separated, to an energy supply and control device arranged, for example, in the area of the stationary bearing device of the spinning rotor.

In a preferred embodiment, the coupling device comprises a coupling plate arranged on the connecting bracket of the first linear guide which, in the operating position of the open-end spinning arrangement, works together with a correspondingly embodied coupling element at the connecting body of the sliver opening unit.

Thus, a coupling element which, for example, is arranged in the area of the sliver opening unit, is embodied as a so-called "mother element", whose contact bushings are in contact with the individual drive mechanisms of the sliver opening unit.

In the locking position, contact pins which are arranged on the coupling plate, enter into these contact bushings and in this manner constitute an electrically and pneumatically continuous connection.

To assure the exact positioning of the sliver opening unit at any time, the connecting bracket of the first linear guide has a centering device on its rear side. Preferably, the centering device comprises two hardened fitting pins which, in the operating position, enter into corresponding centering bores of a stationary bearing block.

At least one of the centering elements of the centering device functions as a key switch. Thus, in the operating position of the sliver opening unit at least one of the fitting pins acts on an electrical switch such that this switch is kept in the closed position and therefore the supply line to the drive mechanisms of the sliver opening unit carries electrical current.

However, each relative movement between the sliver opening unit and the associated stationary bearing block immediately leads to the opening of the key switch and therefore to an interruption of the energy supply to the individual drive mechanisms.

Thus, the key switch assures in a simple manner that the releasable coupling device inserted into the supply lines for the individual drive mechanisms is always switched to be without electrical current or pressure prior to each separation.

Further details of the invention will be understood from the following description of an exemplary embodiment in conjunction with the accompanying drawings.

DETAILED DESCRIPTION OF THE PREFERRED EMBODIMENT

Figure 1:
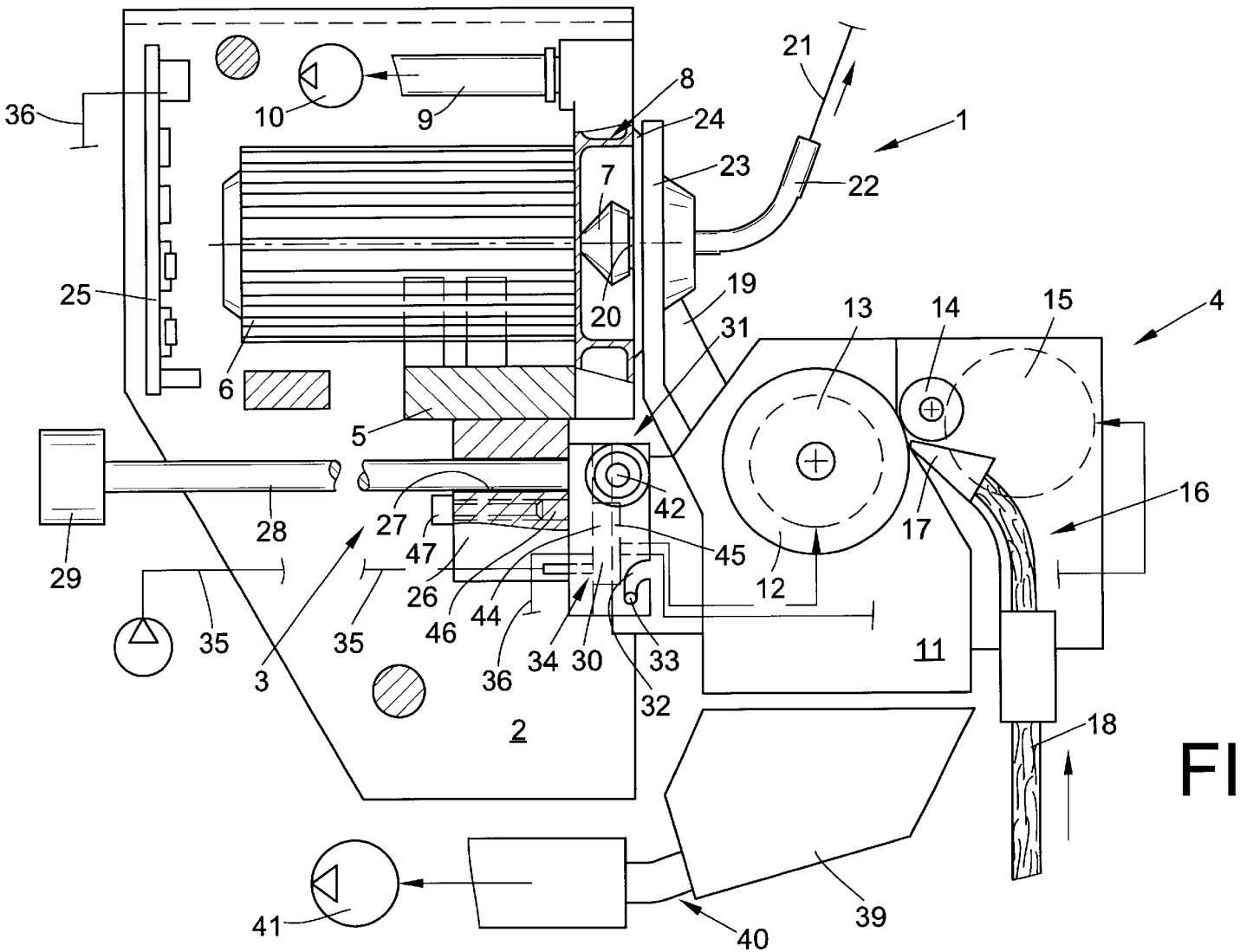
FIG. 1 schematically depicts the spinning operation of an open-end spinning arrangement according to the present invention, having a stationary spinning box housing and a sliver opening unit displaceably connected thereto by means of a linear guide, with a pivot shaft and a locking device arranged on a connecting bracket of this linear guide.

Referring now to the accompanying drawings and initially to FIG. 1, an open-end spinning arrangement in accordance with the present invention is identified as a whole by the reference numeral 1 and is represented in its operating position, i.e. in the closed state.

In the exemplary embodiment represented, the open-end spinning arrangement 1 has a stationary spinning box housing 2, as well as a sliver opening unit 4, which is displaceably connected relative to the spinning box housing 2 by means of a linear guide 3.

A bearing device 5 is arranged inside the spinning box housing 2 which receives an individual drive 6 for a spinning rotor 7. As is customary, the spinning cup of the spinning rotor 7 revolves in a rotor housing 8, which is connected via a pneumatic line 9 to a vacuum source 10 and can be closed by means of a seal 24 inserted into a cover element 23 of the sliver opening unit 4.

As indicated, an energy supply and control device 25, which is a part of the spinning unit, is also arranged inside the spinning box housing 2.

As is customary, the sliver opening unit 4 has an opening roller housing 11, in which rotates an opening roller 12 driven by an individual motor.

The sliver opening unit 4 also has a sliver draw-in cylinder 14 which is driven by a step motor 15.

The opening roller 12 in the present exemplary embodiment is driven by a d.c. motor 13 embodied as an external rotor motor, and thereby separates a sliver 18 supplied from a sliver condenser 16 into individual fibers (not represented) in a known manner.

Thus, the sliver 18, which is fed into the opening roller housing 11 between a feeding trough 17 of the sliver condenser 16 and the sliver draw-in cylinder 14, is separated into individual fibers, which are thereafter pneumatically conducted to the spinning rotor 7 through a fiber guide conduit 19, which terminates in a so-called conduit plate adapter 20 formed in the cover element 23.

In the course of this operation, the individual fibers are directly fed through the mouth of the fiber guide conduit 19 in the conduit plate adapter 20 onto an oppositely located fiber slide surface of the spinning rotor 7.

A yarn 21 created in the course of the spinning process in the spinning rotor 7 is removed through a small yarn removal tube 22 and is wound into a cheese (not represented).

As represented in FIG. 1, the rotor housing 8 charged with a vacuum is closed during the spinning operation via the seal 24 introduced into the cover element 23 arranged on the sliver opening unit 4. The sliver opening unit 4 is fixed in place on a connecting bracket 30 of a first linear guide 3 and is pivotable and, if required, easily releasable.

The first linear guide 3 itself is essentially comprised of a stationary bearing block 26, which is fixed in place on the spinning box housing 2 against removal, for example by a welded connection.

Figure 8:
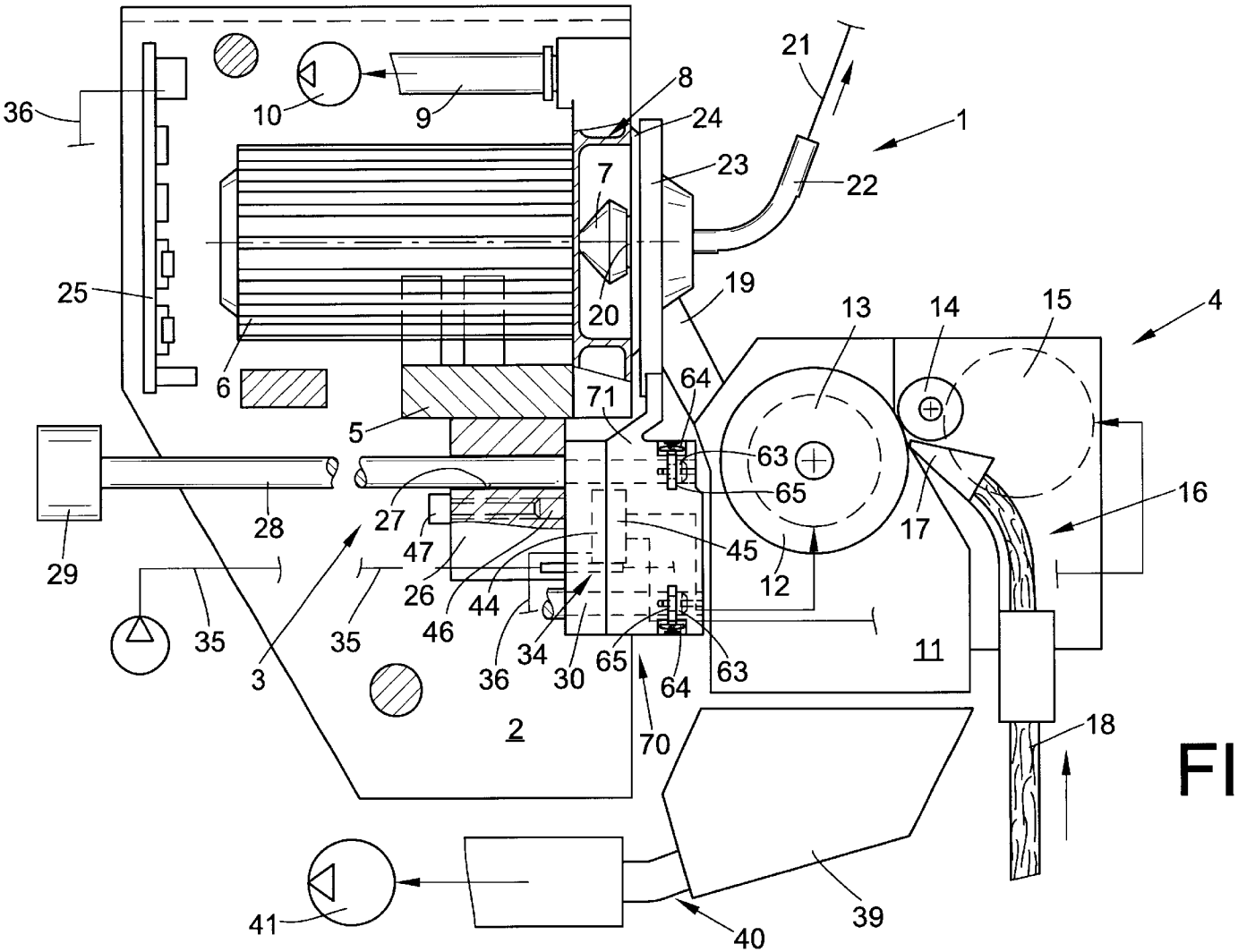
FIG. 8 is a schematic illustration of an open-end spinning arrangement with a linear guide in accordance with FIGS. 1 to 3, wherein a second linear guide for the releasable connection of the sliver opening unit is arranged in the area of the connecting bracket for the linear guides.

In accordance with the exemplary embodiment, for example of FIGS. 1 and 8, the bearing block 26 has guide bores 27, in which elongated guide members, for example two cylindrical guide rods 28, are slidingly guided.

The guide rods 28 of this first linear guide 3 are connected at their rearward ends by means of a spacer 29, while their forward ends are fixedly seated in a connecting bracket 30.

Figure 4:
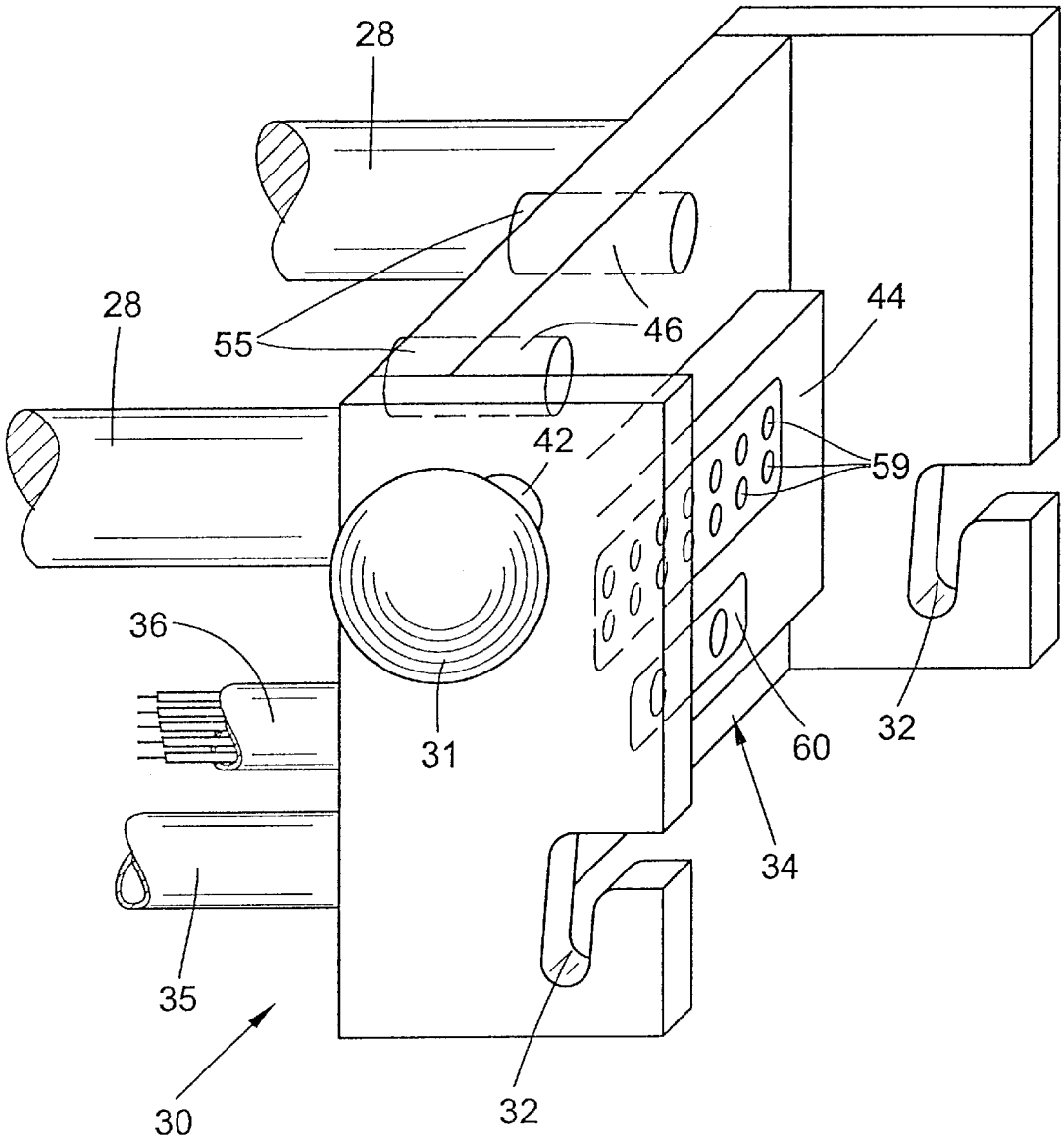
FIG. 4 is a top perspective view depicting a first embodiment of the connecting bracket of the first linear guide with a coupling plate of an electrical/pneumatic coupling device.

In accordance with the exemplary embodiment in FIG. 1, the connecting bracket 30 has a locking device 31, a guide slot 32 for a pivot shaft 33 arranged on the sliver opening unit 4, as well as a coupling plate 44 of an electric/pneumatic coupling device 34, which will be explained hereinafter by way of example with the aid of FIG. 4.

Additionally, the open-end spinning arrangement 1 preferably has a pneumatic dirt removal device 40. In the operating position of the open-end spinning arrangement indicated in FIG. 1 or FIG. 8, a dirt reception funnel 39 of this dirt removal device 40 is positioned exactly underneath the dirt outlet of the sliver opening unit 4.

As indicated in the drawing figures, the dirt removal device 40 either has its own vacuum source 41, or the dirt removal device 40 is connected directly to the vacuum system of the open-end spinning arrangements 1, i.e. to the vacuum source 10.

Figure 2:
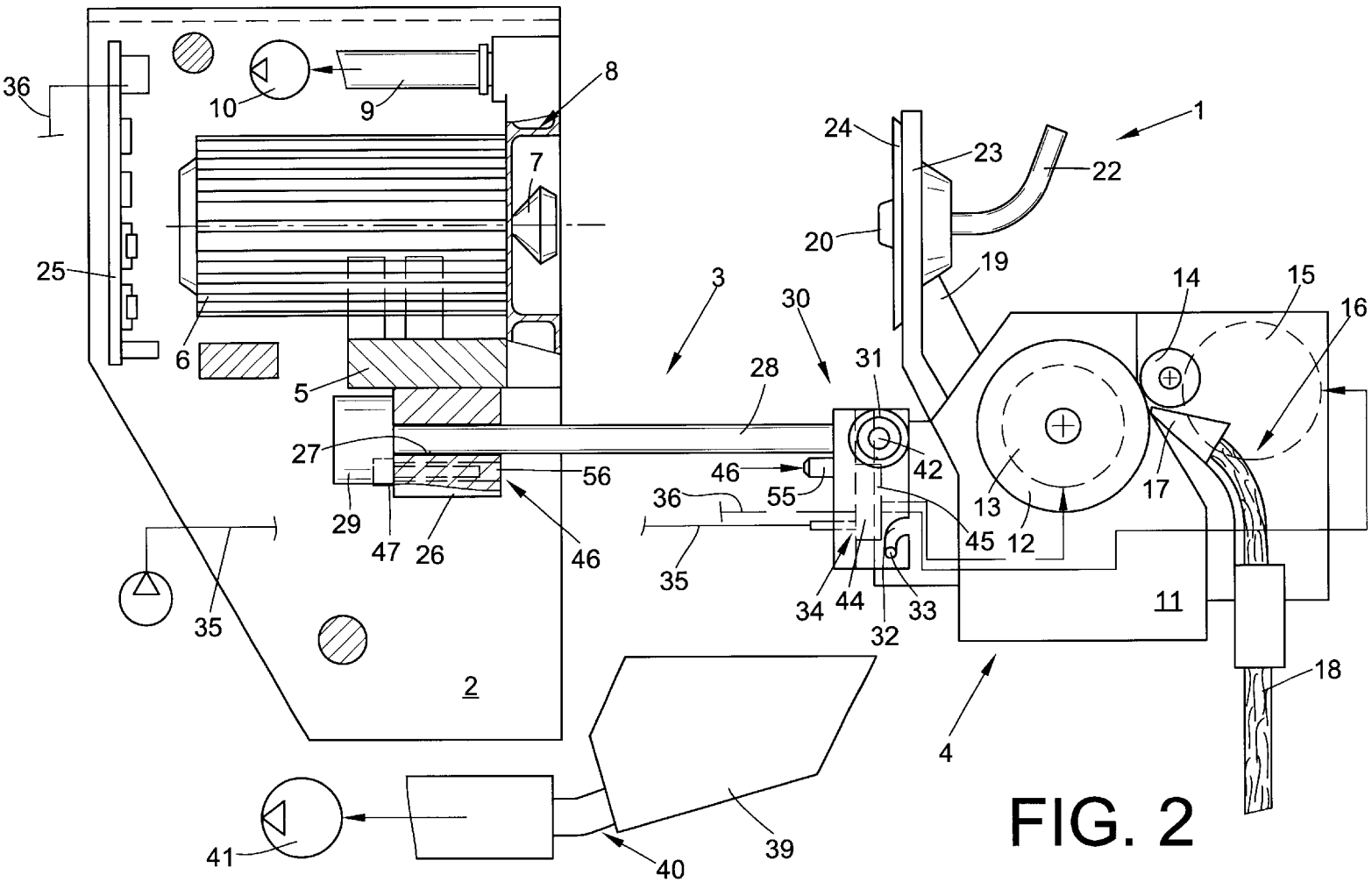
FIG. 2 is a similar schematic illustration of the open-end spinning arrangement represented in FIG. 1 in a non-operating condition wherein the rotor housing is open because of a linear displacement of the sliver opening unit.

FIG. 2 shows the above described open-end spinning arrangement 1 in a position wherein the sliver opening device 4 has been horizontally displaced by means of the first linear guide 3 into a rear position, i.e. the rotor housing of the open-end spinning arrangement is open.

In this manner, the cover element 23, or the seal 24 in the sliver opening unit 4, have been separated from the rotor housing 8, which is open toward the front of the arrangement, so that the spinning rotor 7 is already relatively easily accessible.

Figure 5:
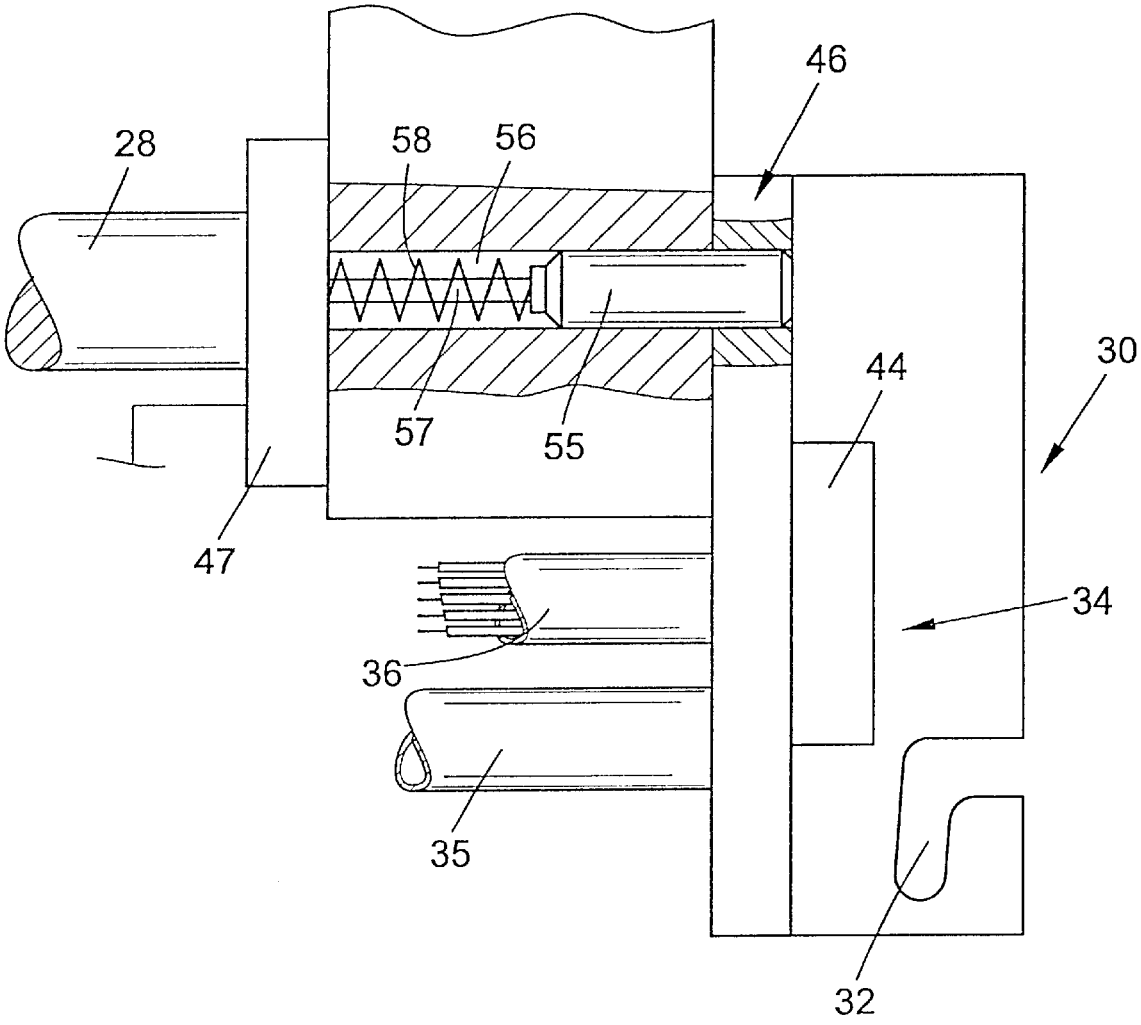
FIG. 5 is an elevational view, partially cross-sectioned, of a centering device arranged on the connecting bracket, which has a centering element acting on a key switch.

In the position represented in FIG. 2, the centering device 46 represented in greater detail in FIG. 5, is out of service, and the coupling device 34 is thus without electrical current and pressure.

More specifically, the centering bolts 55, which as a rule are hardened, of the centering device 46 have been withdrawn from their associated centering bores 56. In this case, at least one of these centering bolts 55 has released a pusher 57 on which a spring element 58 of a key switch 47 acts and in this manner has caused the interruption of the energy supply to the individual drive mechanisms 13, 15 in the sliver opening unit 4.

As indicated above, in the position represented in FIG. 2, the sliver opening unit 4 is still fixedly locked to the connecting bracket 30 of the first linear guide via the pivot shaft 33, as well as the locking device 31, while the electrical current supply has already been switched off by the key switch 47.

Figure 3:
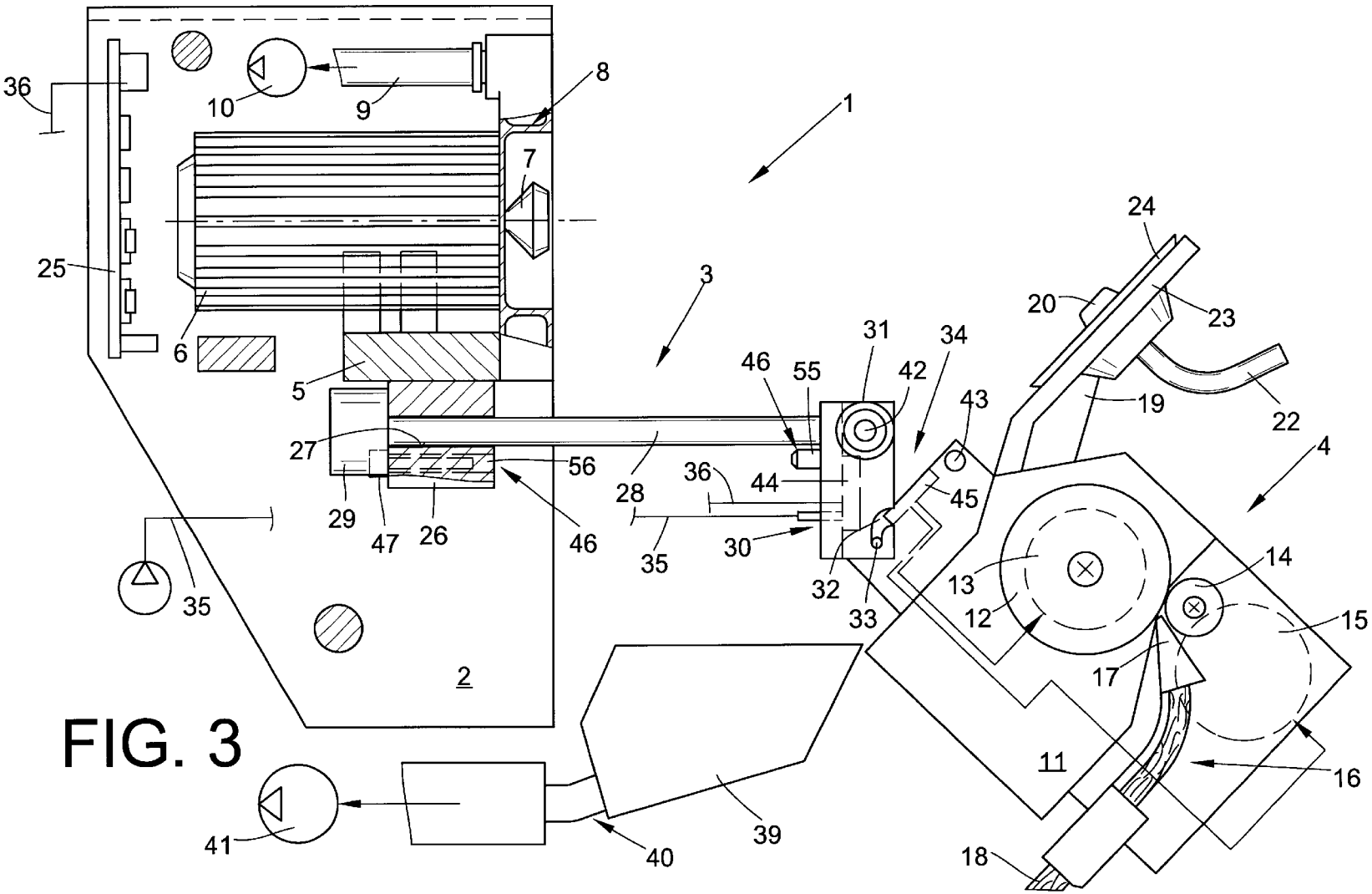
FIG. 3 is a schematic illustration of the open-end spinning arrangement in accordance with FIG. 2, wherein the sliver opening unit has been outwardly tilted around the pivot shaft in the area of the connecting bracket.

By means of releasing the locking device 31, i.e. following the retraction of the manually operable locking bolt 42 out of the connecting bore 43 in the sliver opening unit 4, the sliver opening unit 4 can be tilted around the pivot shaft 33, as indicated in FIG. 3, and can be removed without problems through the forwardly-open guide slots 32, if required.

In the course of this tilting process, the electrical/pneumatic coupling device 34, which is also without electrical current and pressure, is disconnected. Specifically, a coupling element 45 arranged on the sliver opening device 4, whose electrical components have spring-loaded contact pins, for example, is pivoted backward together with the sliver opening unit 4 such that these contact pins lose their mechanical contact at the contacts 59 of the coupling plate 44.

In the course of this pivoting movement of the sliver opening unit 4, a pneumatic coupling 60 which is in contact with the pneumatic lines 35, is also disconnected.

Figure 6:
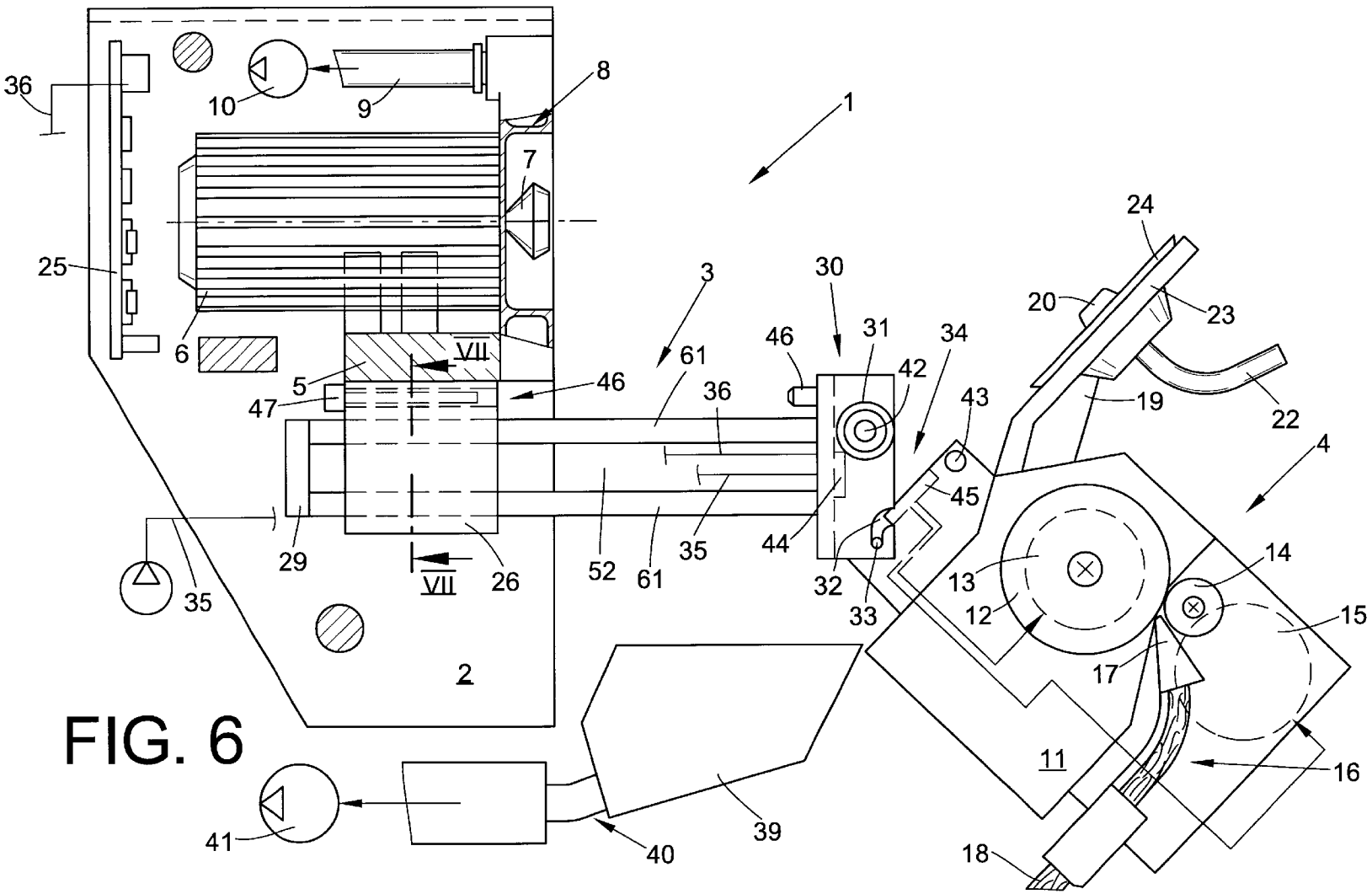
FIG. 6 is a schematic illustration of an open-end spinning arrangement in accordance with FIG. 1 with a second embodiment of a first linear guide.
Figure 7:
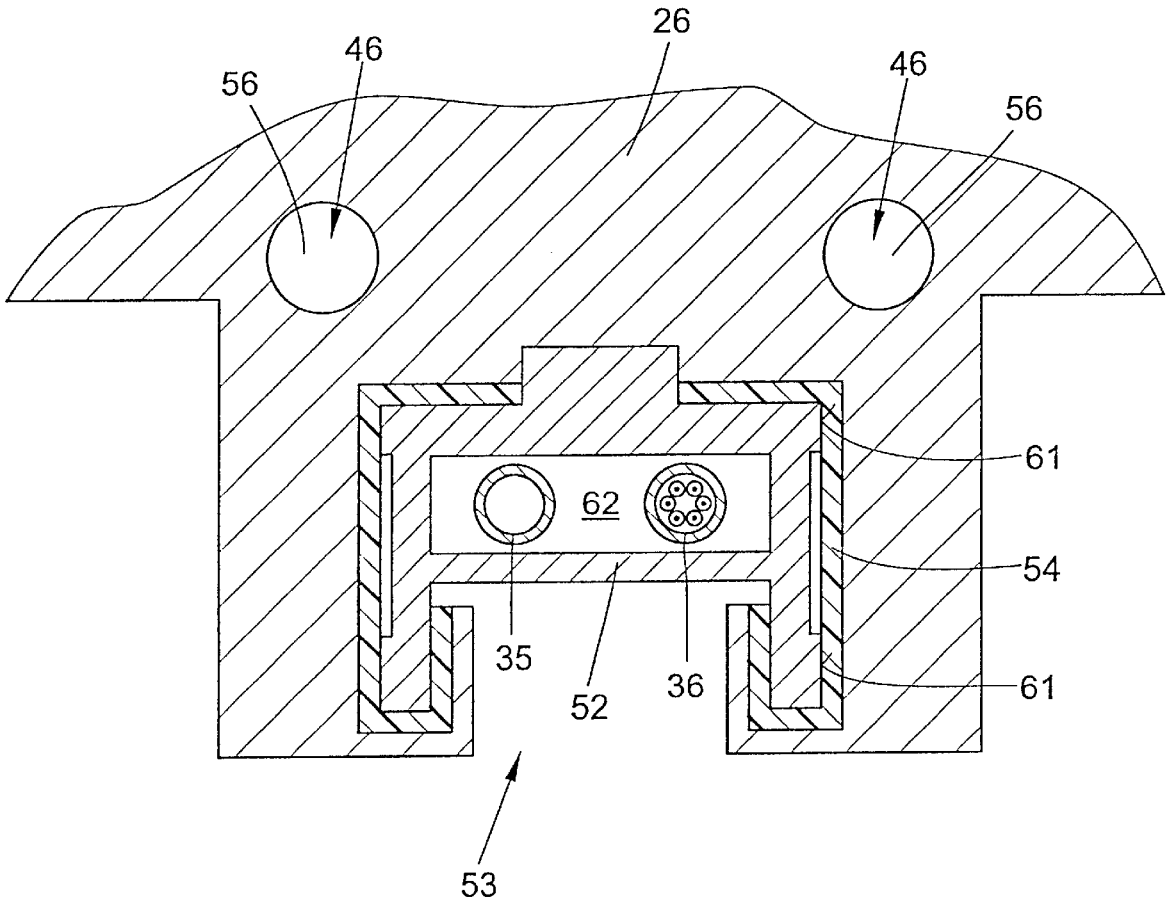
FIG. 7 is a cross-sectional view, taken along section line VII—VII in FIG. 6, of a bearing block for receiving the linear guide represented in FIG. 6.

FIGS. 6 and 7 show a further possible embodiment of such a first linear guide 3.

In such embodiment, a box-like hollow profiled element 52 is provided in place of cylindrical guide rods.

The hollow profiled element 52 is displaceably seated in a cutout 53 of a stationary bearing block 26 and preferably has sliding faces 61, which are spaced apart from each other on its exterior, as can be seen in FIG. 7 in particular. These sliding faces 61 are guided in a bearing bushing 54, which is fixed in place in the cutout 53 of the bearing block 26 and is made of brass, for example.

In this manner, the bearing bushing 54, which may be made as one or two parts, guides the hollow profiled section 52 over large surfaces, so that a stable guide device is provided.

A conduit 62 arranged inside the hollow profiled section 52 can be used in this embodiment for receiving the supply lines 35, 36.

Figure 9:
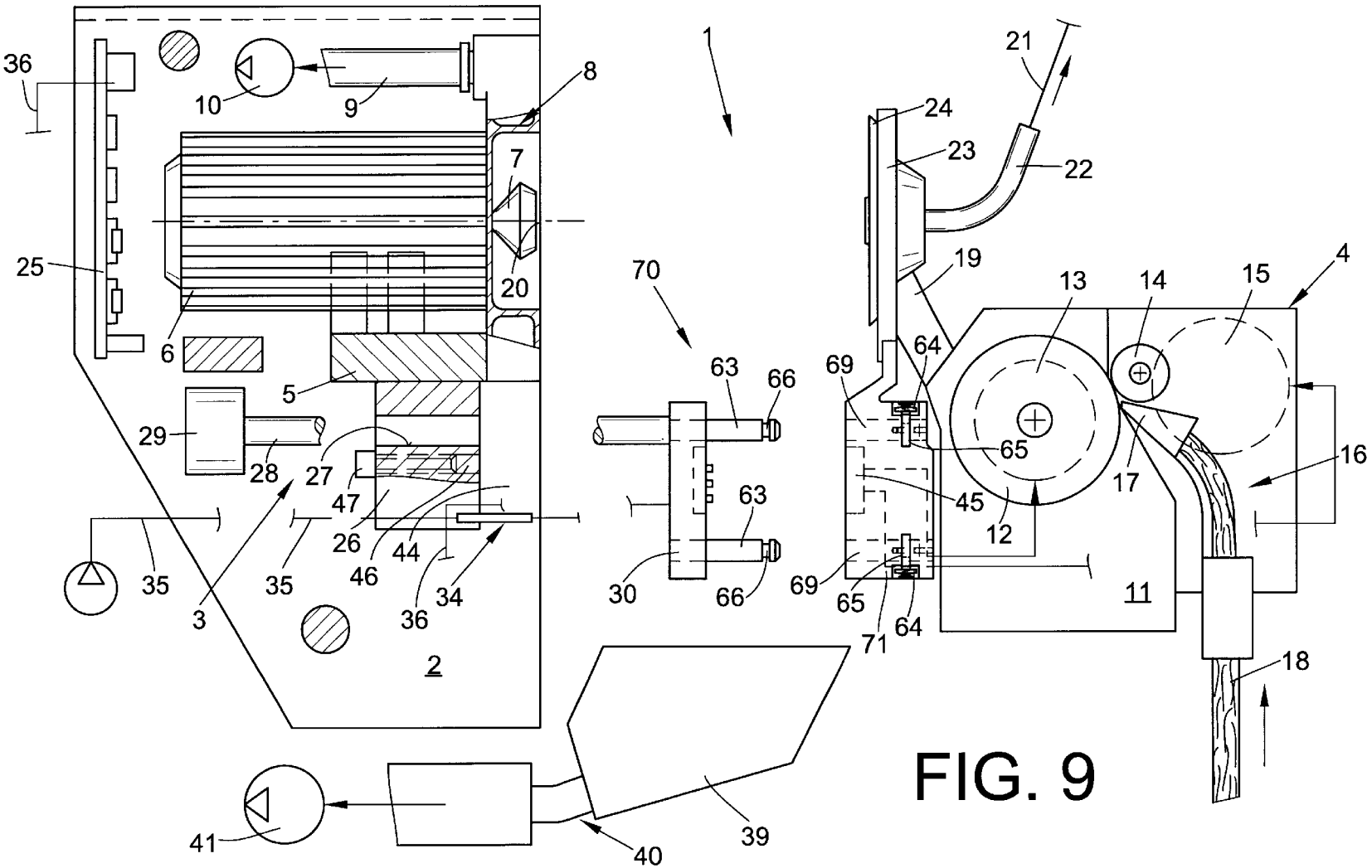
FIG. 9 is a schematic illustration of the open-end spinning arrangement in accordance with FIG. 8, wherein the second linear guide is represented in a separated state.
Figure 10:
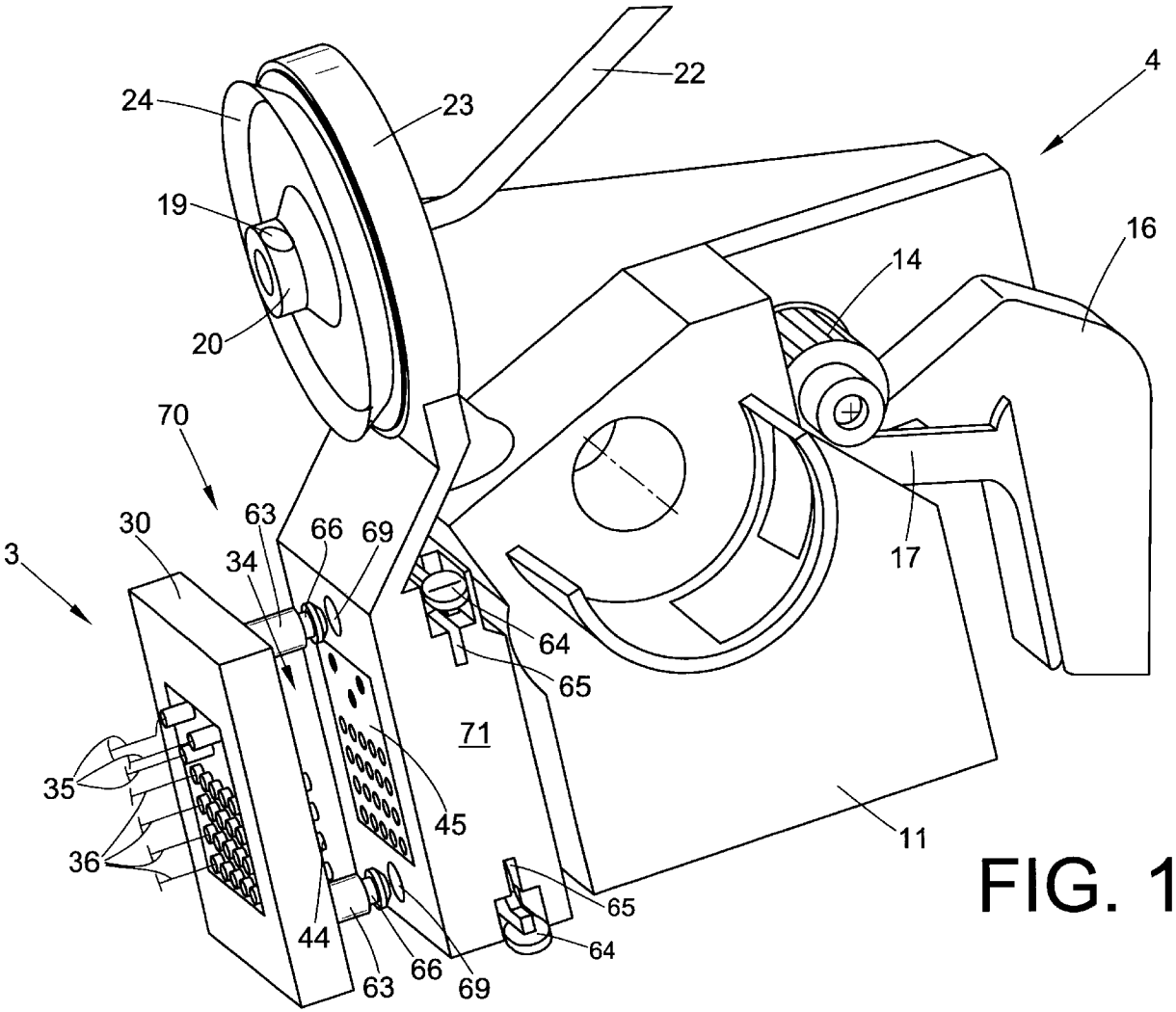
FIG. 10 is a top perspective view of the connecting bracket of the first linear guide with the guide bolts of the second linear guide, as well as the coupling device, arranged in the area of the second linear guide.

FIGS. 8, 9 and 10 show a further preferred embodiment of the invention.

As known from the embodiment in accordance with FIGS. 1 to 3, the releasably arranged sliver opening unit 4 is displaceably connected with the stationary spinning box housing 2 by means of a first linear guide 3.

However, here a second linear guide 70 is arranged in the area of the connecting bracket 30 of the first linear guide 3, which is essentially comprised of relatively short guide bolts 63 fixed in place in the connecting bracket 30, as well as guide bores 69 cut into the connecting body 71 of the sliver opening unit 4.

In the area of their free ends, the guide bolts 63 each have an arresting groove 66, which in the installed state is engaged by one of the locking levers 64 arranged on the connecting body 71 of the sliver opening unit 4.

Figure 11:
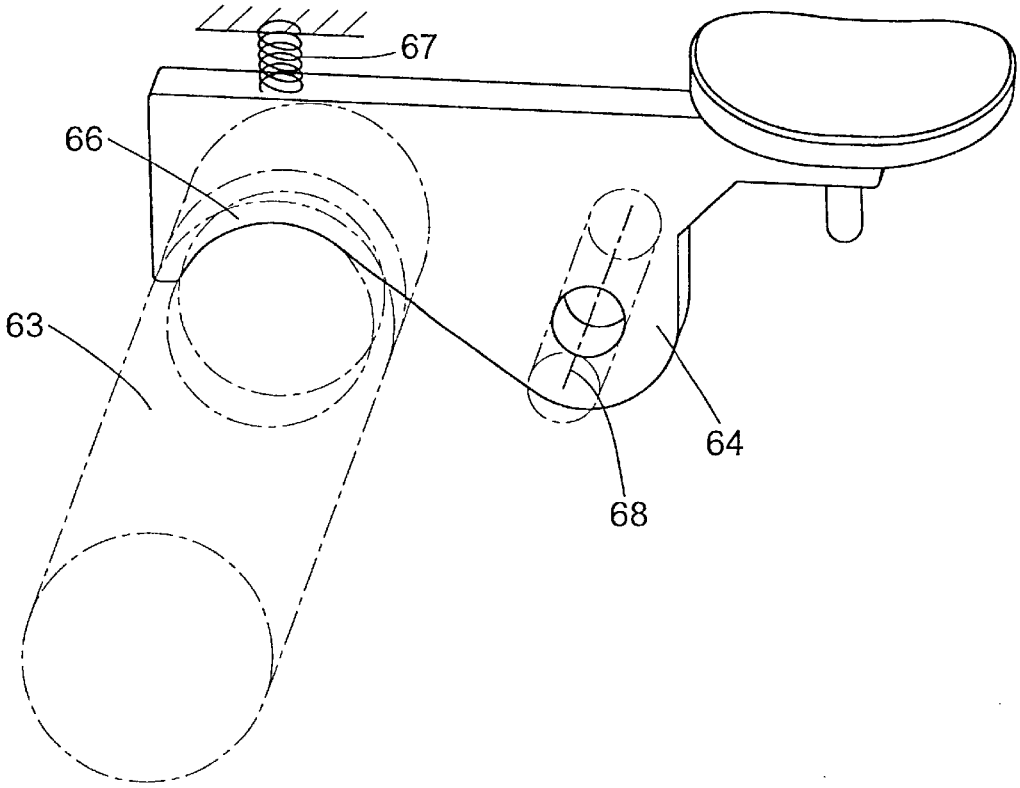
FIG. 11 is a detailed perspective view of an arresting lever for the second linear guide.

The locking levers 64, which are shown in greater detail in FIGS. 10 and 11 in particular, are seated for limited rotatability around a pivot shaft 68, in vertical guide slots 65 of the connecting body 71.

In addition, the arresting levers 64 are acted upon, for example by a spring element 67, in a manner such that in the installed state they automatically snap into the arresting grooves 66 at the guide bolts 63 and thereby fix the sliver opening unit 4 securely, but to be easily releasable at any time in case of need, in place on the connecting bracket 30 of the first linear guide 3.

Furthermore, a coupling device 34 is arranged between the connecting bracket 30 of the first linear guide 3 and the connecting body 71 of the sliver opening unit 4. This coupling device 34, which can be released by a relative movement of the second linear guide 70, has a coupling plate 44, which is fixed in place on the connecting bracket 30 and has contact plugs, which work together with appropriate contact bushings of a coupling element 45 arranged on the contact body 71 of the sliver opening unit 4, as indicated by way of example in FIG. 10.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning arrangement, comprising a stationary spinning box housing adapted to be arranged on a base frame of a textile machine for seating a high speed spinning rotor in a vacuum-charged rotor housing, a sliver opening unit connected releasably to the spinning box housing via a connecting bracket of a linear guide, and a cover element for closing the rotor housing, the sliver opening unit comprising an opening roller driven by an individual motor and a sliver draw-in cylinder driven by a step motor arranged inside the sliver opening unit.

2. The open-end spinning arrangement in accordance with claim 1, characterized in that the sliver opening unit is mounted on the connecting bracket via a pivot shaft seated in forwardly open guide slots of the connecting bracket for relative pivoting movement of the sliver opening unit and via a locking device for fixation of the sliver opening unit relative to the connecting bracket.

3. The open-end spinning arrangement in accordance with claim 2, characterized in that the locking device comprises a spring-biased locking bolt displaceably seated on the connecting bracket and a connecting bore arranged in the connecting body of the sliver opening unit.

4. The open-end spinning arrangement in accordance with claim 1, characterized in that a second linear guide is connected to the connecting bracket and has guide bolts which act together with corresponding guide bores in the connecting body of the sliver opening unit.

5. The open-end spinning arrangement in accordance with claim 4, characterized in that at least one of the guide bolts has an arresting groove.

6. The open-end spinning arrangement in accordance with claim 4, characterized in that vertical guide slots are arranged in the area of the guide bores in the connecting body of the sliver opening unit, in each of which a manually operable locking lever is arranged.

7. The open-end spinning arrangement in accordance with claim 6, characterized in that the locking levers are biased in an inwardly pivoted direction by a spring element.

8. The open-end spinning arrangement in accordance with claim 1, characterized in that an external electric motor is arranged for driving the opening roller.

9. The open-end spinning arrangement in accordance with claim 1, characterized in that a coupling device connected with supply lines is arranged in the area of the connecting bracket.

10. The open-end spinning arrangement in accordance with claim 9, characterized in that the coupling device comprises a coupling plate arranged on the connecting bracket and a corresponding coupling element arranged on a connecting body of the sliver opening unit.

11. The open-end spinning arrangement in accordance with claim 1, characterized in that a centering device is arranged between the connecting bracket and a bearing block arranged in the area of a spinning rotor bearing device.

12. The open-end spinning arrangement in accordance with claim 11, characterized in that the centering device has at least one centering element comprising a key switch.

13. The open-end spinning arrangement in accordance with claim 1, characterized in that a stationary dirt reception funnel of a pneumatic dirt removal device is arranged below the sliver opening unit.

14. The open-end spinning arrangement in accordance with claim 1, characterized in that the spinning rotor is acted upon by an individual electric motor drive.

15. The open-end spinning arrangement in accordance with claim 1, characterized in that an axis of the opening roller and an axis of the sliver draw-in cylinder are arranged orthogonally in respect to an axis of the spinning rotor.

* * * * *